US006698683B2

(12) United States Patent
Young

(10) Patent No.: US 6,698,683 B2
(45) Date of Patent: Mar. 2, 2004

(54) BATHROOM TISSUE DISPENSER AND HOLDER

(76) Inventor: George E. Young, 6256 Gloria Dr. #8, Sacramento, CA (US) 95831

( * ) Notice: Subject to any disclaimer, the term of this patent is extended or adjusted under 35 U.S.C. 154(b) by 0 days.

(21) Appl. No.: 10/185,374

(22) Filed: Jun. 28, 2002

(65) Prior Publication Data

US 2004/0000612 A1 Jan. 1, 2004

(51) Int. Cl.[7] ..... B65H 75/18

(52) U.S. Cl. ..... 242/597.8; 212/597; 242/594; D6/521

(58) Field of Search ..... 242/597.8, 597.5, 242/597, 594, 560.2, 594.6; D6/521

(56) References Cited

U.S. PATENT DOCUMENTS 2,647,028 A * 7/1953 Larson ..... 225/6
2,959,368 A * 11/1960 Neff ..... 242/560.3
3,138,340 A * 6/1964 Caravella ..... 242/597.5
3,157,370 A * 11/1964 Govatsos et al. ..... 242/560.2
D238,465 S * 1/1976 Bauman ..... D6/521
4,416,425 A * 11/1983 Kish ..... 242/598.1
5,009,313 A * 4/1991 Morand ..... 206/391
5,248,105 A * 9/1993 Cooker ..... 242/598.5
D386,028 S * 11/1997 Schneider ..... D6/521
D386,339 S * 11/1997 Schneider ..... D6/521
5,749,538 A * 5/1998 Brown et al. ..... 242/559.2
6,302,604 B1 * 10/2001 Bryant et al. ..... 400/619
6,450,439 B1 * 9/2002 van Rees ..... 242/597.7

* cited by examiner

*Primary Examiner*—Kathy Matecki
*Assistant Examiner*—Evan Langdon
(74) *Attorney, Agent, or Firm*—John L. James

(57) ABSTRACT

A bathroom tissue dispenser and holder has arms positioned between and interconnected to the arms of a conventional wall mounted tissue holder. A roller is pivotally connected one arm of the tissue dispenser and holder and pivots away the mounting wall to replace the roll of tissue. When refilled, the roller pivots towards back the wall. A leg suspended from the arms supports two feet above the bathroom floor. Each foot has an upright member for holding a spare roll of bathroom tissue.

16 Claims, 3 Drawing Sheets

BATHROOM TISSUE DISPENSER AND HOLDER

TECHNICAL FIELD OF THE INVENTION

This invention relates to generally to a device for dispensing bathroom tissue, and, more particularly, to a device for holding and dispensing bathroom tissue.

BACKGROUND OF THE INVENTION

Common household bathroom tissue dispensers dispense single or multiple sheets of tissue from a roll of tissue. The roll of tissue is held on a roller between two arms. The two arms hold the roller in a stationary position so that tissue can be unrolled as needed. When the roll of tissue is exhausted, the cardboard tissue holder is removed from the roller and replaced with a new roll of tissue. When the roll is empty, a new roll of tissue has to located which can be problematic, especially when the empty roll is not noticed before using the bathroom facilities. It is desirable to keep a spare roll of tissue in the bathroom. In public restrooms, tissue holders often have a storage compartment because it increases the cost of the holder and increases the space requirement for the holder.

Spare rolls of tissue are often kept on a shelf in the bathroom or in a cabinet in the bathroom. These storage facilities present a problem when the tissue is needed before it is noticed that the tissue holder is empty. A solution to this problem is to keep spare rolls of tissue on a tissue holder, comprised of a base supporting an upright rod, on the floor next to or within easy reach of the toilet. While spare tissue holder that rest on the floor place spare rolls within easy reach, they clutter the floor and interfere with floor cleaning. Also, owing to the fact that floor is colder than the surrounding air, paper placed at floor level is in jeopardy of absorbing condensation moisture as well as moisture from the atmosphere. Accordingly, it will be appreciated that it would be highly desirable to have a tissue dispenser that holds spare rolls of tissue within easy reach and holds them above floor level.

Conventional tissue holders typically have a spring loaded roller that tensions the roller to hold it in place between the arms of the tissue holder. The roller is a two piece device with two telescoping cylindrical members and an internal coil spring. Replacing a spent roll of tissue requires use of both hands for many people because the spring loaded two piece roller. It is desirable to replace a spent roll of tissue without having to wrestle with a spring loaded two piece roller.

SUMMARY OF THE INVENTION

The present invention is directed to overcoming one or more of the problems set forth above. Briefly summarized, according to one aspect of the invention, a. combination bathroom tissue dispenser and holder for dispensing a first roll of bathroom tissue paper and holding spare rolls of bathroom tissue paper comprises a laterally extending elongate shoulder member having first and second end portions and a middle portion intermediate the first and second end portions. A first upwardly extending arm is connected to the first end portion of the shoulder member, and a second upwardly extending arm is connected to the second end portion of the shoulder member. A roller, adapted to hold the first roll of bathroom tissue, is pivotally connected to one of the first and second arms and extends toward the other arm.

A leg extends downwardly from the middle portion of the shoulder. At least one upstanding finger, adapted to hold a spare roll of bathroom tissue, is attached to the leg and spaced from the leg.

A bathroom tissue dispenser and holder device attaches to a conventional bathroom tissue dispenser where the roller normally attaches. The device has arms with protrusions that engage the openings in the tissue holder where the roller normally engages openings in the holder. The arms are resilient to provide positive engagement with the holder so that the device remains engaged during normal use.

According to another aspect of the invention, a device for dispensing a roll of bathroom tissue paper comprises a laterally extending elongate shoulder member having first and second end portions and a middle portion intermediate the first and second end portions. A first upwardly extending arm is connected to the first end portion of the shoulder member. The first arm has an inside surface and an outside surface with a protrusion, adapted to fit into an opening in a bathroom tissue holder to mount the device, extending away from the inside surface. A second upwardly extending arm is connected to the second end portion of the shoulder member. The second arm has an inside surface and an outside surface with a protrusion, adapted to fit into an opening in a bathroom tissue holder to mount the device, extending away from the inside surface. A roller, adapted to hold a roll of bathroom tissue, is pivotally connected to one of the first and second arms and extends toward the other of the first and second arms. The inside surface of the second arm has a bracket thereon for mounting the roller.

The device replaces the roller of an existing bathroom tissue dispenser. The device has only two pieces and is free of springs. A pivotal roller swings out when replacing a roll of bathroom tissue so that replacing the roll requires the use of only one hand.

According to another aspect of the invention a bathroom tissue holder comprises a laterally extending platform and means for mounting the platform. First and second upstanding fingers, each adapted to hold a roll of tissue paper, are attached to the platform. Mounting the holder below an existing bathroom tissue dispenser conveniently places spare rolls of tissue where they are easily accessible.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
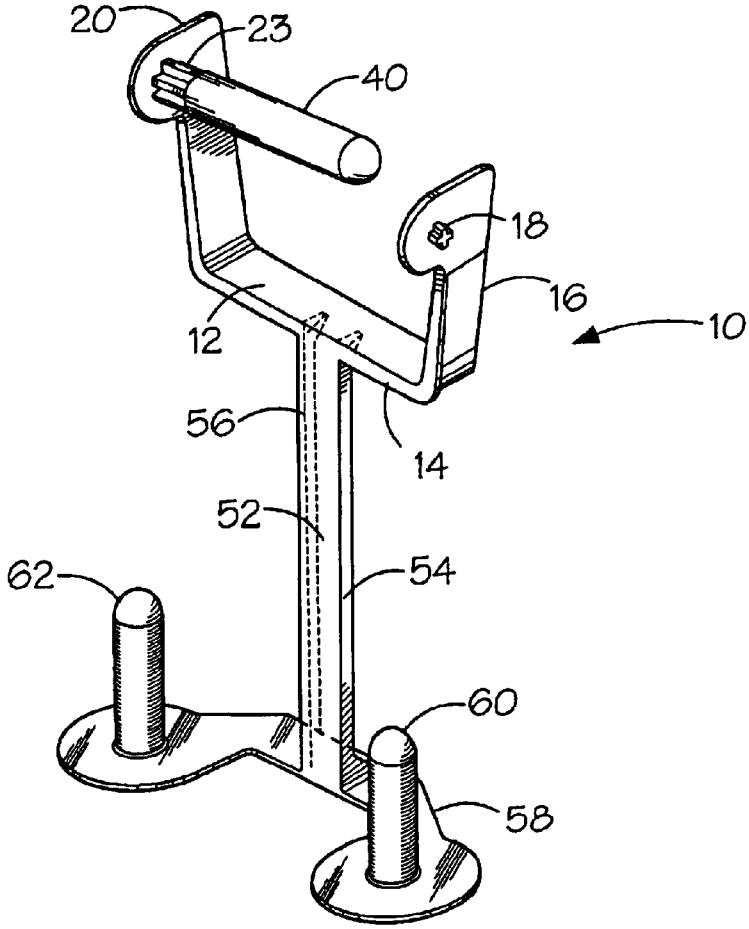
FIG. 1 is a perspective view of a preferred embodiment of a tissue dispensing and holding device according to the present invention.

Referring to FIG. 1, a device 10 for holding a roll of bathroom tissue and dispensing sheets from the roll has a laterally extending elongated shoulder 12 with left and right end portions and a middle portion intermediate the left and right end portions. The shoulder 12, and remainder of the device 10, is preferably constructed of metal or plastic, but wood could also be used. Plastic is preferred because both pieces can be injection molded using a single mold. To conserve material, the thickness of shoulder 12 and other components is relatively thin, on the order of 0.12 inches or so and strategically reinforced with ribs of a height on the order of 0.17 inches or so. Shoulder 12 has a reinforcing rib 14 forming a front face thereon.

A right upwardly extending arm 16 is connected to the right end portion of the shoulder 12. It also has a reinforcing rib forming a front face of the right arm 16. The right arm 16 has an inside surface and an outside surface with a protrusion 18 extending away from the inside surface. Protrusion 18 is adapted to fit into an opening in a bathroom tissue holder to mount the device.

Figure 5:
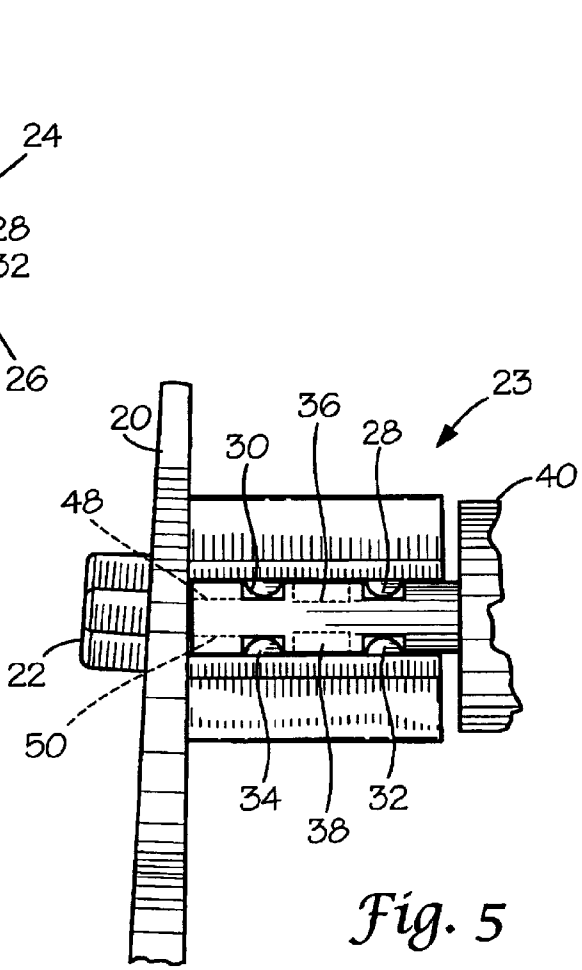
FIG. 5 is a front view of showing the connection of the roller to the left arm.
Figure 4:
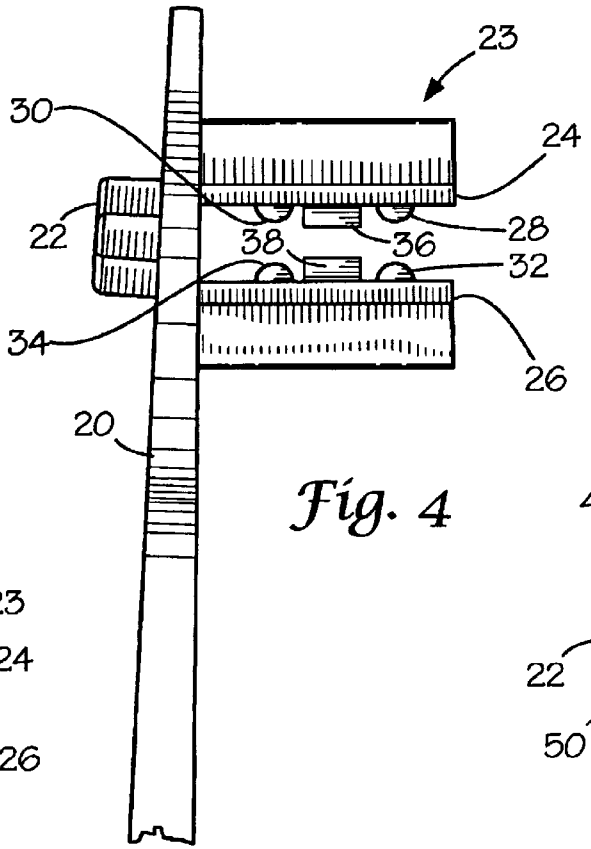
FIG. 4 is a front view of the left arm of FIG. 3.
Figure 3:
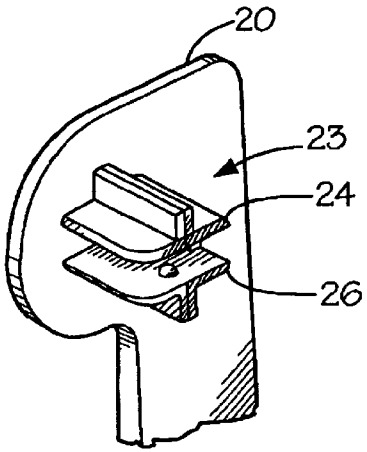
FIG. 3 is fragmentary view of the inside of the left arm of the device of FIG. 1.

Referring to FIGS. 1, 4 and 5, a left upwardly extending arm 20 is connected to the left end portion of the shoulder 12. It also has a reinforcing rib forming a front face of the left arm 20. The reinforcing ribs of the left and right arms may be joined to the reinforcing rib 14 of the shoulder 12 forming a continuous rib. The left arm 20 has an inside surface and an outside surface with a protrusion 22 extending away from the inside surface. Protrusion 22 is adapted to fit into an opening in a bathroom tissue holder to mount the device. Arms 16, 20 are substantially parallel to one another when the device is installed, but spread apart from one another when not installed. The spread arms are slightly compressed when installed to hold the protrusions in their respective openings providing positive engagement to lock the arms in the openings.

Referring to FIGS. 1, 3, 4, and 5, the inside surface of the left arm 20 has a bracket 23 thereon for mounting said a roller 40. The bracket 23 has top and bottom members 24, 26 each having an interior surface with front pin and rear pins spaced apart and extending from the interior surface. Top member 24 contains front pin 28 and rear pin 30 while bottom member 26 contains front pin 32 and rear pin 34. The front and rear pins are linearly aligned horizontally. The front pins of the top and bottom members are aligned vertically, and the rear pins of the top and bottom members are aligned vertically.

Top member 24 includes a top stop member 36 positioned between the front and rear pins 28, 30 and transversely displaced from the front and rear pins in contrast to the lateral displacement of the pins from one another. Similarly, bottom member 26 includes a bottom stop member 38 positioned between the front and rear pins 32, 34 and laterally displaced from the front and rear pins.

Figure 2:
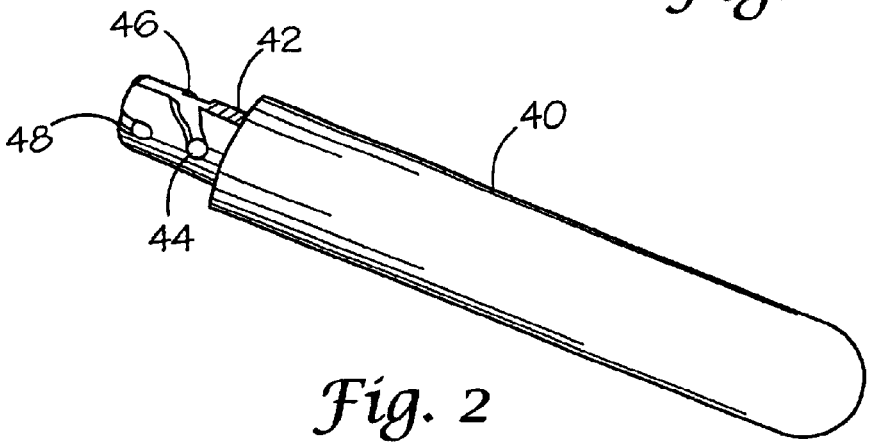
FIG. 2 is perspective view of the roller of FIG. 1.

Referring to FIGS. 1 and 2, roller 40 is pivotally connected to the left arm 20 and is adapted to hold the first roll of bathroom tissue for dispensing. The roller 40 has a connecting arm 42 with top and bottom surfaces and side and end faces. The top surface has a top groove 44 beginning at the side face and extending into the top surface while the bottom surface has a bottom groove 46 beginning at the side face and extending into the bottom surface. The top and bottom grooves 44, 46 mirror one another across connecting arm 42 and are wider at the side face than at their bottom in their respective surfaces. The top surface has a top end groove 48 beginning at the end face and extending into the top surface while the bottom surface has a bottom end groove 50 (shown in phantom in FIG. 5) beginning at the end face and extending into the bottom surface. The top and bottom end also grooves mirror one another. The top and bottom grooves 44, 46 extend generally transversely, while the top end and bottom end grooves 48, 50 extend laterally.

When assembled, top rear pin 30 rests in end groove 48 while bottom rear pin 34 rests in end groove 50. Once assembled, pins 30, 34 always rests in grooves 48, 50, respectively. Front top pin rests in top groove 44 when assembled and bottom front pin 32 rests in groove 46. When roller 40 is pivoted outward to receive a roll of bathroom tissue, front pins 28, 32 disengage their grooves. When pivoting inward, stop members 36, 38 abut the grooved side face of arm 42 to halt rearward movement. The stop members 36, 38 compensate for variances in grooves 44 and 46 due to wear, misuse or manufacturing tolerances. Because the pins rest in the grooves, the interior surfaces of the bracket make contact with the surfaces of the arm to hold the arm firmly while the distal end of the arm remains unsupported.

A leg 52 extends downwardly from the middle portion of the shoulder 12. The leg 52 has a front face extending between left and right side edges. A right reinforcing rib 54 forms a side face on the right side edge while a left reinforcing rib 56 (shown in phantom in FIG. 1) forms a side face on the left side edge. A laterally extending platform 58 is attached along a bottom portion of leg 52. A right finger 60 is upstanding from platform 58 and attached spaced from leg 52. The right finger 60 is adapted to hold a first spare roll of bathroom tissue. A left finger 62 is also upstanding from platform 58 and spaced from leg 52. The left finger 62 is adapted to hold a second spare roll of tissue paper. If desired, each finger can be lengthened to accommodate more than one reserve roll of tissue.

Figure 6:
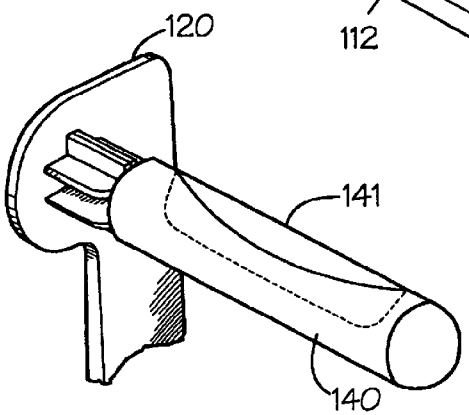
FIG. 6 is a fragmentary perspective view of another preferred embodiment a roller attached to a left roller arm.

FIG. 6 illustrates another roller 140, similar to roller 40 of FIG. 2, attached to an upstanding arm 120. Roller 140 defines a cavity 141 adapted to hold an odor eliminator to neutralize bathroom odors, a fragrance substance to impart a peasant odor, or a deodorizer that accomplishes both. Roller 140 may have perforations along its length and distal end to aid in distributing the deodorizer.

Figure 7:
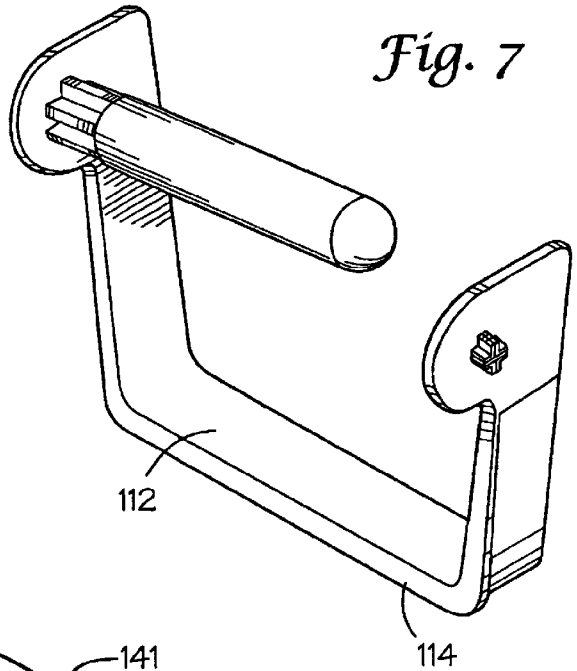
FIG. 7 is a perspective view of a preferred embodiment of a tissue dispenser according to the present invention.

FIG. 7 illustrates a bathroom tissue dispenser that is the same as the upper portion of the combination device of FIG. 1. It differs only in the shoulder area where the shoulder 112 has a rib 114 that is uninterrupted by a downwardly extending leg.

Figure 8:
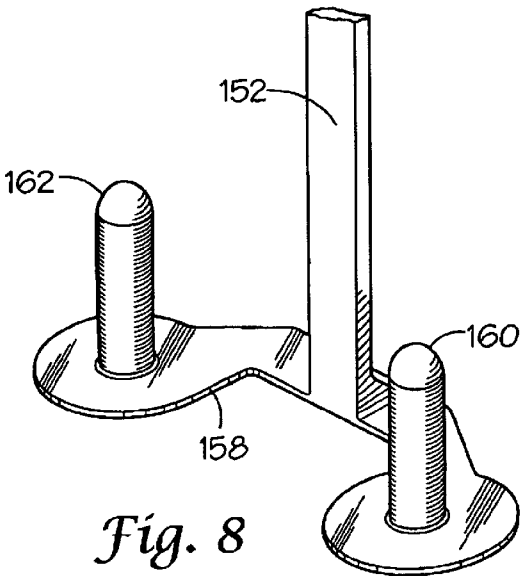
FIG. 8 is a perspective view of a preferred embodiment of a tissue holder according to the present invention.

FIG. 8 illustrates a bathroom tissue holder that is the same as the lower portion of the combination device of FIG. 1 except that side reinforcing ribs are not required. Leg 152 is attached to platform 158 which supports upstanding fingers 160 and 162. Leg 152 may have a mounting hole for receiving a nail, screw or similar fastener so that the holder can be mounted on a wall below an existing dispenser. Alternatively, an adhesive, mounting tape or the like may be used on the rear face of the leg 152. Because reinforcing ribs are absent, the rear surface is a flat surface suitable for tape or adhesive. Also, leg 152 may be shortened or replaced with a mounting bracket preferably formed with platform 158.

It can now be appreciated that a bathroom tissue dispenser and holder has been presented for dispensing sheets from one roll of paper while holding spare rolls in reserve. The combination device fits in a typical dispenser where the roller is normally positioned. Resilient upstanding arms provide tension to force protrusions into the roller openings of a conventional paper holder to firm hold the device in position during use. The roller can be pivoted outwardly with one hand to remove a spent roll and insert a fresh roll of paper. Fresh reserve rolls of paper a held ready on the upstanding finger supported by the downwardly projecting leg.

While the invention has been described with particular reference to the preferred embodiments, it will be understood by those skilled in the art that various changes may be made and equivalents may be substituted for elements of the preferred embodiments without departing from invention. For example, while the roller has been described as being pivotally connected to the left arm, it could be pivotally connected to the right arm instead leaving its distal left end free. Also, it is possible to make the combination device a stand alone unit by releasably attaching the distal end of the roller to the right arm with a latch, catch or the like.

As is evident from the foregoing description, certain aspects of the invention are not limited to the particular details of the examples illustrated, and it is therefore contemplated that other modifications and applications will occur to those skilled in the art. For example, the roller can be attached to the bracket with a single pivot pin that extends through the arm of the roller and both the top and bottom members of the bracket. Also, the bracket can have a single member attached to the roller arm with a pin or with a turntable. It is accordingly intended that the claims shall cover all such modifications and applications as do not depart from the true spirit and scope of the invention.

What is claimed is:

1. A bathroom tissue dispenser and holder for dispensing a first roll of bathroom tissue paper and holding spare rolls of bathroom tissue paper, comprising:

a laterally extending elongate shoulder member having first and second end portions and a middle portion intermediate said first and second end portions;

a first upwardly extending arm connected to said first end portion of said shoulder member;

a second upwardly extending arm connected to said second end portion of said shoulder member;

a roller, adapted to hold the first roll of bathroom tissue, pivotally connected to one of said first and second arms and extending toward the other of said first and second arms, said roller pivoting outward to accept the first roll of bathroom tissue and pivoting inward to hold the roll of bathroom tissue;

a leg extending downwardly from said middle portion of said shoulder; and a first finger upstanding from said leg and being attached to said leg and spaced from said leg, said first finger adapted to hold a first spare roll of bathroom tissue;

wherein said second arm has an inside surface and an outside surface, said outside surface having a protrusion extending away from said inside surface and adapted to fit into an opening in a bathroom tissue holder to mount said dispenser and holder, said inside surface having a bracket thereon for mounting said roller; and wherein said bracket has top and bottom members each having an interior surface with a front pin and a rear pin extending from said interior surface.

2. A bathroom tissue dispenser and holder, as set forth in claim 1, wherein said shoulder has a reinforcing rib forming a front face of said shoulder.

3. A bathroom tissue dispenser and holder, as set forth in claim 1, wherein said first arm has a reinforcing rib forming a front face of said arm.

4. A bathroom tissue dispenser and holder, as set forth in claim 1, including a reinforcing rib forming a front face of said shoulder, said first arm and said second arm.

5. A bathroom tissue dispenser and holder, as set forth in claim 1, wherein said first arm has an inside surface and an outside surface with a protrusion extending away from said inside surface, said protrusion being adapted to fit into an opening in a bathroom tissue holder to mount said dispenser and holder.

6. A bathroom tissue dispenser and holder, as set forth in claim 1, wherein said front and rear pins are aligned horizontally.

7. A bathroom tissue dispenser and holder, as set forth in claim 6, wherein said front pins of said top and bottom members are aligned vertically, and said rear pins of said top and bottom members are aligned vertically.

8. A bathroom tissue dispenser and holder, as set forth in claim 1, wherein said top member includes a top stop member positioned between said front and rear pins and laterally displaced from said front and rear pins.

9. A bathroom tissue dispenser and holder, as set forth in claim 1, wherein said bottom member includes a bottom stop member positioned between said front and rear pins and laterally displaced from said front and rear pins.

10. A bathroom tissue dispenser and holder, as set forth in claim 1, wherein said leg has a front face extending between first and second side edges, a first reinforcing rib forming a side face on said first side edge, and a second reinforcing rib forming a side face on said second side edge.

11. A bathroom tissue dispenser and holder, as set forth in claim 1, including second finger upstanding from said leg and being attached to said leg and spaced from said leg, said finger adapted to hold a second spare roll of tissue paper.

12. A bathroom tissue dispenser and holder, as set forth in claim 11, wherein said leg has a laterally extending platform attached along a bottom portion thereof, said first and second fingers being attached to said platform and extending upward therefrom.

13. A bathroom tissue dispenser and holder for dispensing a first roll of bathroom tissue paper and holding spare rolls of bathroom tissue paper, comprising:

a laterally extending elongate shoulder member having a first and second end portions and a middle portion intermediate said first and second end portions;

a first upwardly extending arm connected to said first end portion of said shoulder member, a second upwardly extending arm connected to said first end portion of said shoulder member;

a roller, adapted to hold the first roll of bathroom tissue, pivotally connected to one of said first and second arms and extending toward the other of said first and second arms, said roller pivoting outward to accept the first roll of bathroom tissue and pivoting inward to hold the roll of bathroom tissue;

a leg extending downwardly from said middle portion of said shoulder; and a first finger upstanding from said leg and being attached to said leg and spaced from said leg, said first finger adapted to jold a first spare roll of bathroom tissue; and wherein said roller has a connecting arm with a top surface, side face, bottom surface and an end face, said top surface having a top groove beginning at said side face and extending into said top surface, said bottom surface having a bottom groove beginning at said side face and extending into said bottom surface, said top and bottom grooves mirroring one another, said top surface having a top end groove beginning at said end face and extending into said top surface, said bottom surface having a bottom end groove beginning at said end face and extending into said bottom surface, said top and bottom end grooves mirroring one another.

14. A bathroom tissue dispenser and holder, as set forth in claim 13, wherein said top end groove extends laterally and said top groove extends transversely.

15. A device for dispensing a roll of bathroom tissue paper, comprising:

a laterally extending elongate shoulder member having first and second end portions and a middle portion intermediate said first and second end portions;

a first upwardly extending arm connected to said first end portion of said shoulder member, said first arm having an inside surface and an outside surface with a protrusion extending away from said inside surface, said protrusion being adapted to fit into an opening in a bathroom tissue holder to mount said device;

a second upwardly extending arm connected to said second end portion of said shoulder member, said second arm having an inside surface and an outside surface, said outside surface having a protrusion extending away from said inside surface and adapted to fit into an opening in a bathroom tissue holder to mount said device; and a roller, adapted to hold a roll of bathroom tissue, pivotally connected to one of said first and second arms and extending toward the other of said first and second arms, said inside surface of said second arm having a bracket thereon for mounting said roller, said roller pivoting outward to accept the first roll of bathroom tissue and pivoting inward to hold the roll of bathroom tissue;

wherein said bracket has top and bottom members each having an interior surface with a front pin and a rear pin extending from said interior surface, said front and rear pins being aligned horizontally, said front pins of said top and bottom members being aligned vertically, and said rear pins of said top and bottom members being aligned vertically.

16. A bathroom-tissue dispenser and holder, as set forth in claim 15, wherein said roller has a connecting arm with a top surface, side face, bottom surface and an end face, said top surface having a top groove beginning at said side face and extending into said top surface, said bottom surface having a bottom groove beginning at said side face and extending into said bottom surface, said top and bottom grooves mirroring one another, said top surface having a top end groove beginning at said end face and extending into said top surface, said bottom surface having a bottom end groove beginning at said end face and extending into said bottom surface, said top and bottom end grooves mirroring one another.

* * * * *